US009017186B2

(12) United States Patent
Jertson et al.

(10) Patent No.: US 9,017,186 B2
(45) **Date of Patent: *Apr. 28, 2015**

(54) CLUB HEADS WITH MULTIPLE DENSITY WEIGHTING AND METHODS OF MANUFACTURING THE SAME

(71) Applicant: Karsten Manufacturing Corporation, Phoenix, AZ (US)

(72) Inventors: Martin R. Jertson, Cave Creek, AZ (US); John A Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 40 days.

This patent is subject to a terminal disclaimer.

(21) Appl. No.: 13/900,334

(22) Filed: May 22, 2013

(65) Prior Publication Data

US 2013/0267346 A1 Oct. 10, 2013

Related U.S. Application Data

(63) Continuation-in-part of application No. 12/762,182, filed on Apr. 16, 2010, now Pat. No. 8,449,405.

(60) Provisional application No. 61/186,311, filed on Jun. 11, 2009.

(51) Int. Cl.

| | |
|---|---|
| ***A63B 53/00*** | (2006.01) |
| ***A63B 53/04*** | (2006.01) |
| ***B23P 11/00*** | (2006.01) |
| ***B23P 15/00*** | (2006.01) |
| ***B23P 17/04*** | (2006.01) |

(52) U.S. Cl.

CPC ..... *A63B 53/04* (2013.01); *A63B 2209/00* (2013.01); *A63B 2225/64* (2013.01); *A63B 2053/0491* (2013.01); *A63B 53/0475* (2013.01); *A63B 53/0466* (2013.01); *A63B 53/0487* (2013.01)

(58) Field of Classification Search

CPC ..... A63B 53/0475; A63B 2053/0491; A63B 2225/64; A63B 2209/00

USPC ..... 473/324–350, 287–292, 256, 409; 29/428, 469.5, 505

See application file for complete search history.

(56) References Cited

U.S. PATENT DOCUMENTS

| | | | |
|---|---|---|---|
| 1,167,387 | A | 1/1916 | Daniel |
| 2,846,228 | A | 8/1958 | Reach |
| 4,085,934 | A | 4/1978 | Churchward |
| 5,385,348 | A | 1/1995 | Wargo |
| 5,720,673 | A | 2/1998 | Anderson |
| 5,935,019 | A | 8/1999 | Yamamoto |
| 5,967,905 | A | 10/1999 | Nakahara et al. |
| 6,030,295 | A | 2/2000 | Takeda |
| 6,033,321 | A | 3/2000 | Yamamoto |
| 6,056,649 | A | 5/2000 | Imai |
| 6,062,988 | A | 5/2000 | Yamamoto |
| 6,203,448 | B1 | 3/2001 | Yamamoto |
| 6,206,789 | B1 | 3/2001 | Takeda |
| 6,306,048 | B1 | 10/2001 | McCabe et al. |
| 6,319,149 | B1 | 11/2001 | Lee |
| 6,379,265 | B1 | 4/2002 | Hirakawa et al. |
| 6,409,612 | B1 | 6/2002 | Evans et al. |

(Continued)

*Primary Examiner* — Sebastiano Passaniti

(57) ABSTRACT

Embodiments of club heads with multiple density weighting and methods of manufacturing the same are described herein. Other embodiments and related methods are also disclosed herein.

24 Claims, 7 Drawing Sheets

(56) References Cited

U.S. PATENT DOCUMENTS

| | | | | |
|---|---|---|---|---|
| 6,902,495 | B2 | 6/2005 | Pergande et al. | |
| 7,101,291 | B2 | 9/2006 | Yamamoto | |
| 7,244,188 | B2 | 7/2007 | Best | |
| 7,318,782 | B2 | 1/2008 | Imamoto et al. | |
| 7,462,110 | B2 | 12/2008 | Yamamoto | |
| 7,537,528 | B2 | 5/2009 | Rice et al. | |
| 7,572,194 | B2 | 8/2009 | Yamamoto | |
| 7,637,823 | B2 | 12/2009 | Shimazaki et al. | |
| 7,651,410 | B2 | 1/2010 | Shimazaki | |
| 7,775,904 | B2 | 8/2010 | Hirano | |
| 7,828,672 | B2 | 11/2010 | Billings | |
| 7,871,339 | B2 | 1/2011 | Sanchez et al. | |
| 8,257,196 | B1 | 9/2012 | Abbott et al. | |
| 8,449,405 | B2 * | 5/2013 | Jertson et al. | 473/324 |
| 2004/0067799 | A1 | 4/2004 | Yamamoto | |
| 2006/0100029 | A1 | 5/2006 | Lo | |
| 2007/0281796 | A1 | 12/2007 | Gilbert et al. | |
| 2008/0015049 | A1 | 1/2008 | Imamoto | |
| 2013/0303305 | A1 | 11/2013 | Myrhum et al. | |

* cited by examiner

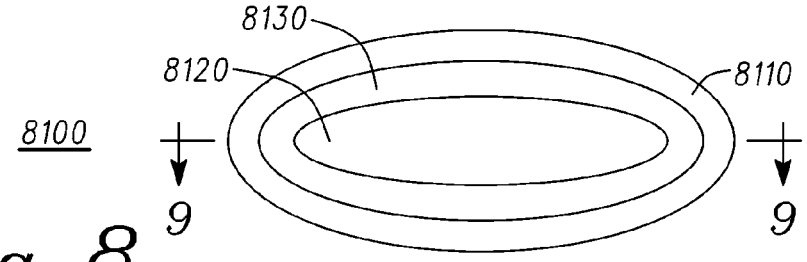
Fig. 8
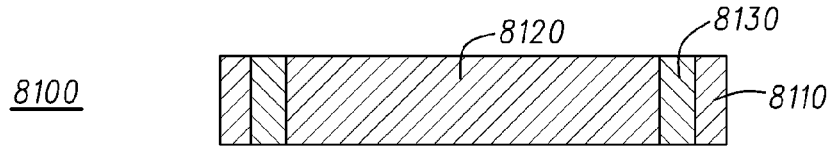
Fig. 9
Fig. 10
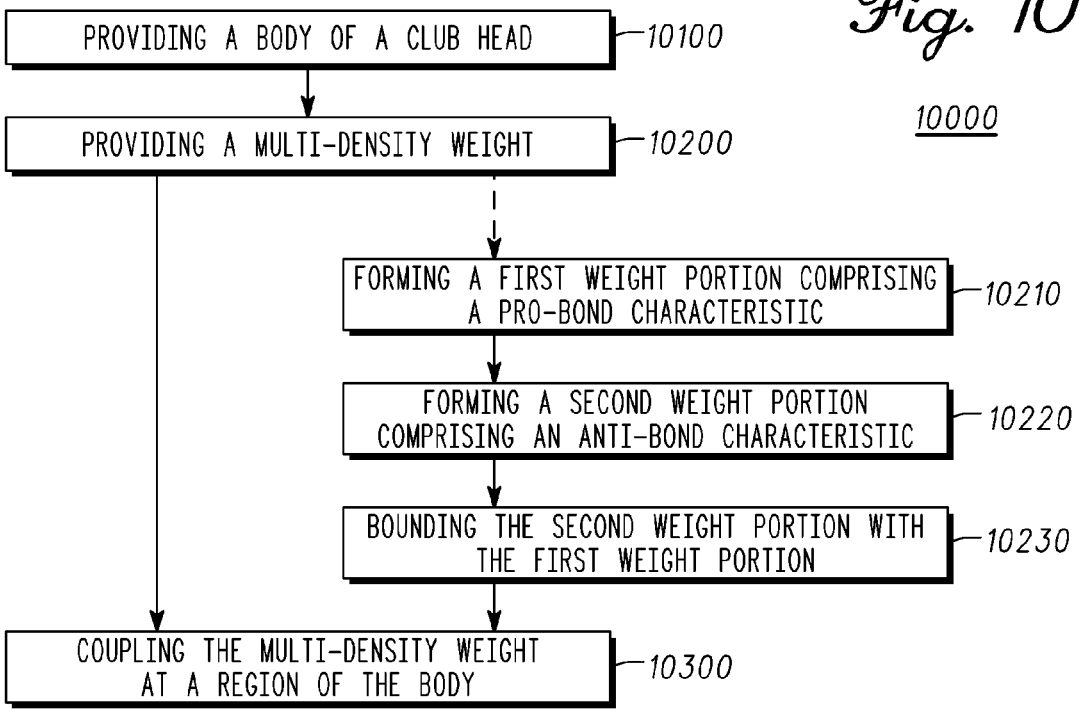

CLUB HEADS WITH MULTIPLE DENSITY WEIGHTING AND METHODS OF MANUFACTURING THE SAME

CROSS-REFERENCE TO RELATED APPLICATIONS

This application is a continuation-in-part to U.S. patent application Ser. No. 12/762,182, filed on Apr. 16, 2010, which claims priority to U.S. Provisional Patent Application Ser. No. 61/186,311, filed Jun. 11, 2009. The disclosures of the applications listed above are incorporated herein by reference.

TECHNICAL FIELD

This disclosure relates generally to sports equipment, and relates more particularly to club heads with multiple density weighting and methods of manufacturing the same.

BACKGROUND

During the evolution of club head design for sports equipment, several strategies have been employed to manipulate or alter the physical and/or gaming characteristics of club heads. For example, golf club heads have been designed to accommodate weights that alter or adjust the distribution of mass across a body of such club heads.

The placement of such weights, however, can be problematic in some situations. For example, there can be cases where materials used to form the weights may not be compatible for proper bonding with materials used to form the body of the club head. In such cases, bonding mechanisms such as welding may not provide the structural integrity required by the bond to withstand stresses while still properly securing the weights to the club head. Using other weight materials that may be compatible for bonding with the body of the club head may lead to other problems, such as unwieldy or larger weight configurations that would be harder to accommodate with the body of the club head for proper weight distribution and/or aesthetic considerations.

Accordingly, needs exist for mechanisms and/or procedures capable of overcoming the limitations described above.

BRIEF DESCRIPTION OF THE DRAWINGS

FIG. 8 presents a top view of a multi-density weight.

FIG. 9 shows a cross sectional view the multi-density weight of FIG. 8, along a line 8-8 of FIG. 8.

FIG. 10 illustrates a flowchart for a method of manufacturing a club in accordance with the present disclosure.

Figure 1:
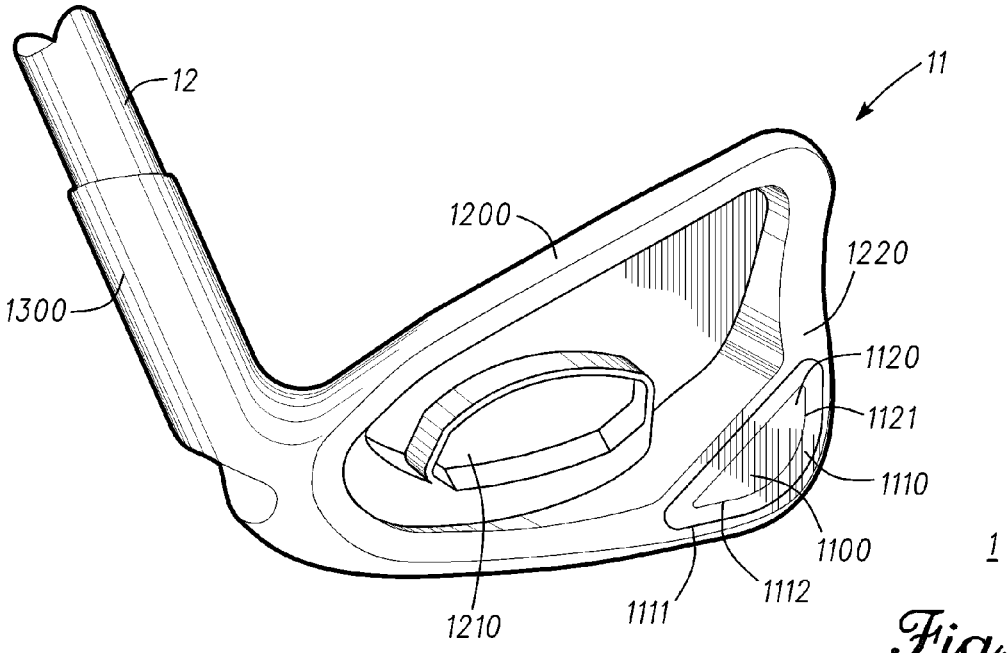
FIG. 1 illustrates a front perspective view of a club having a body and a multi-density weight.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically, magnetically, chemically, and/or otherwise. Two or more mechanical elements may be mechanically coupled together, but not chemically coupled together. Two or more mechanical elements may not be mechanically coupled together, but may be magnetically or chemically coupled together. Coupling may be for any length of time, e.g., permanent or semi-permanent or only for an instant. A mechanical "coupling" and the like should be broadly understood and include mechanical coupling of all types. The absence of the word "removably," "removable," and the like near the word "coupled," and the like does not mean that the coupling, etc. in question is or is not removable.

DESCRIPTION

In one embodiment, an apparatus can comprise a body and a multi-density weight. The body can comprise a receptacle at a surface of the body, where the surface of the body can be proximate to at least one of a hosel, an upper toe region, a lower toe region, a heel region, a backside region, an upper-half region, or a lower-half region of the body. The multi-density weight can comprise a first weight component comprising a first density, an inner portion and a periphery around the inner portion, and a second weight component comprising a second density different from the first density and secured along the inner portion of the first weight component. The body, the first weight component, and the second weight component can comprise materials different from each other, where the second weight component can comprise a material having a weld-averse trait with respect to the body. The receptacle can comprises a receptacle base and a receptacle wall circumscribing the receptacle base, while the multi-density weight can comprise a perimeter secured along the receptacle wall.

Figure 2:
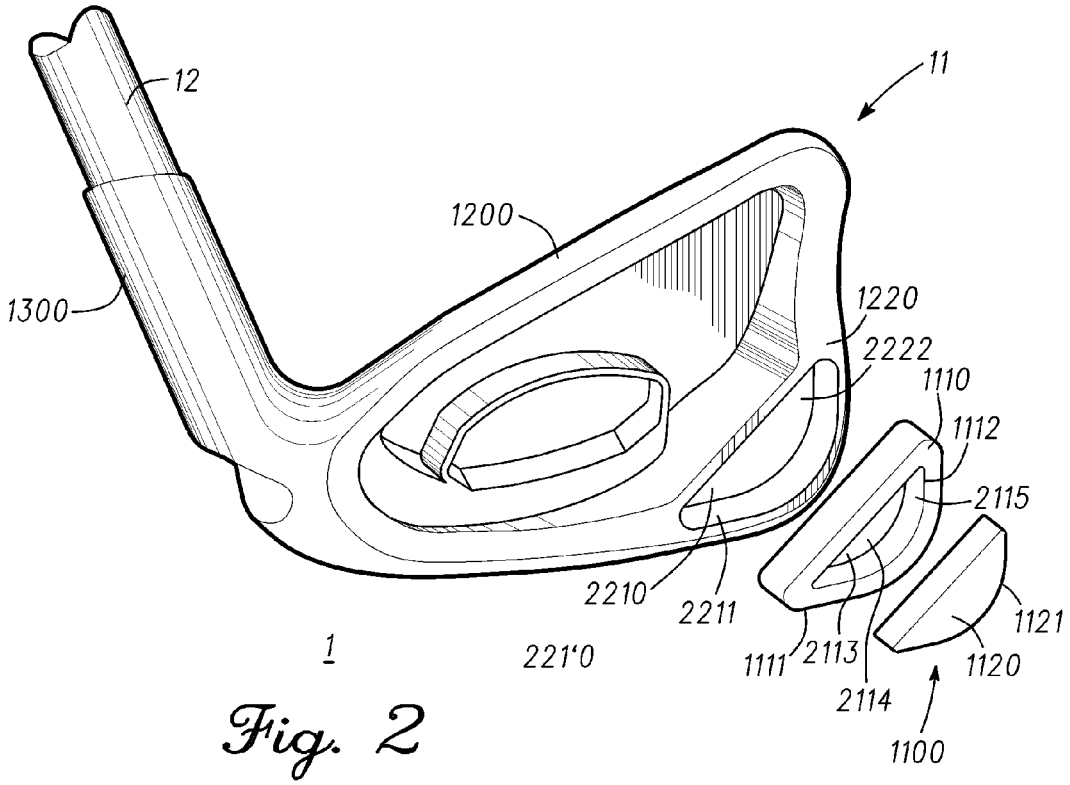
FIG. 2 illustrates an exploded front perspective view of the club of FIG. 1.
Figure 3:
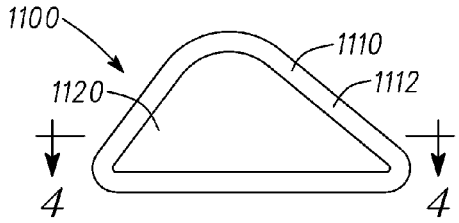
FIG. 3 presents a top view of the multi-density weight of the club of FIG. 1.
Figure 4:
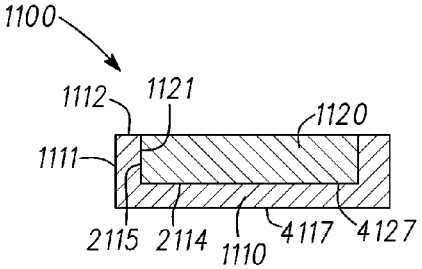
FIG. 4 shows a cross sectional view of the multi-density weight of FIG. 1, along a line 3-3 of FIG. 3.

Referring now to the figures, FIG. 1 illustrates a front perspective view of club 1 having body 1200 and multi-density weight 1100. FIG. 2 illustrates an exploded front perspective view of club 1. FIG. 3 presents a top view of multi-density weight 1100. FIG. 4 shows a cross sectional view of multi-density weight 1100 along a line 3-3 of FIG. 3.

Club 1 is illustrated in FIG. 1 as a golf club, and comprises club head 11 and shaft 12, where club head 11 comprises body 1200 and hosel 1300. Shaft 12 is coupled in the present embodiment to club head 11 via hosel 1300. In a different embodiment, shaft 12 can couple to club head 11 directly without the need of hosel 185, such as through a bore (not shown) into club head 11. Although club head 11 is illustrated herein as an iron head, it will be understood that other embodiments of the present invention can comprise a different type of golf club head, such as a putter head, a driver head, a hybrid head, and a fairway wood head, among others. The teachings in this disclosure are not limited to any specific type of club or club head.

As shown in FIGS. 1-2, multi-density weight 1100 is configured to couple with body 1200 at receptacle 2210. Although receptacle 2210 is located proximate to a lower toe region of body 1200 in the present embodiment, other embodiments may comprise a receptacle at other regions of body 1200, such as at or proximate to an upper toe region, a hosel region, a heel region, a backside region, an upper-half region, and/or at a lower-half region of body 1200. Because multi-density weight 1100 couples to receptacle 2210, the location of receptacle 2210 at body 1200 can be decided based on intended characteristics for club 1, including a desired distribution of mass for club 1 and/or to affect launch angle, hook, or draw performance of club 1.

Multi-density weight 1100 comprises weight component 1110 and weight component 1120 in the present example, where weight component 1110 comprises inner portion 2113 and periphery 1112 around inner portion 2113, and where weight component 1120 is secured along a cavity of the inner portion of weight component 1110. In at least some embodiments, a density of weight component 1120 differs from a density of weight component 1110. For example, in the present embodiment, the density of weight component 1120 is greater than the density of weight component 1110. In addition, the densities of weight components 1110 and/or 1120 can be greater than a density of body 1200. Such relationships between the densities of weight component 1110, weight component 1120, and/or body 1200 can be tailored to adjust or fine tune different characteristics of club 11. For example, the greater the density of weight component 1120 is relative to the densities of weight component 1110 and/or body 1200, the greater effect multiple-density weight 1100 can have in repositioning or affecting a center of gravity of club 11. In the same or a different example, where the density of weight component 1110 is between the densities of weight component 1120 and body 1200, club 11 may exhibit a more gradual and/or less abrupt transition from a portion of lower density to a portion of higher density. In the same or a different example, such relative densities and transitions between densities can be used to improve a "feel" of club 11. In different embodiments, the density of weight component 1120 can be greater than the density of weight component 1110, and both weight components 1110 and 1120 can have densities greater than the density of body 1200.

In some examples, the weight component 1110 may conform to a shape or contour of a surface section one or more of the heel, upper toe, lower toe, hosel, heel, backside, upper-half, and/or lower-half regions of body 1200, thus permitting weight component 1120 to also conform and/or extend across the surface section. In the same or different examples, weight component 1110 can extend across the surface section, and weight component 1120 can be located proximate to an end of the surface section. In some embodiments, top surfaces of weight portions 1110 and 1120 face towards an exterior of golf club head 11 when multi-density weight 1100 couples to receptacle 2210 of body 1200, as illustrated in FIG. 1. In different embodiments, the top surface of weight portions 1110 and 1120 can face towards an interior of golf club head 11 when multi-density height 1100 couples to receptacle 2210 of body 1200. In the same or a different embodiment, the perimeter of at least one of weight component 1110 and/or weight component 1120 is non-circular such as to conform to the shape of the surface section.

In the present example, the materials of body 1200, weight component 1110, and weight component 1120 can differ from each other. For example, in some embodiments, body 1200 can comprise a metallic material or alloy, such as a titanium material and/or a steel material. In some implementations, the titanium material can comprise titanium 6-4, titanium 8-1-1, and/or another material comprising titanium. In the same or other implementations, the steel material can comprise stainless steel, carbon steel, or other types of steel. The material of body 1200 can comprise a density with a specific gravity of, for example, approximately 4.0 to approximately 8.5. For instance, the material of body 1200 can comprise a titanium material with a specific gravity of approximately 4.0 to approximately 4.8. As another example, the material of body 1200 can comprise a steel material with a specific gravity of approximately 7.25 to approximately 8.5.

In the same or a different embodiment, weight component 1110 can comprise a material such as a metallic alloy comprising a tungsten alloy, a tungsten-nickel alloy, and/or a copper alloy. There can be examples where the material of weight component 1110 can comprise a density with a specific gravity of, for example, approximately 8 to approximately 11.

In the same or a different embodiment, weight component 1120 can comprise a heavier material, such as a tungsten material, a gold material, a brass material, a lead material, and/or alloys thereof, and can have a density greater than the density of weight component 1110, with a specific gravity of, for example, approximately 14 to approximately 20.

In the same or other examples, a material of multi-density weight 1100 may also impart enhanced vibrational characteristics for club head 11. For instance, where a material of multi-density weight 1100, such as the material of weight component 1110, comprises a modulus of elasticity lower than that of a material of body 1200 of club head 11, improved impact feel may be achieved because the modulus of elasticity plays a large role in determining the mechanical vibration of the club head. In one example, the material of weight component 1110 comprises a tungsten-nickel alloy having a modulus of elasticity of approximately 19,500 thousand pounds per square inch (Kpsi) or 134,400 MegaPascals, while the material of body 1200 can comprise a steel material having a larger modulus of elasticity of approximately 23,000 Kpsi or 160,000 MegaPascals.

There can be embodiments where the material of weight component 1120 can comprise characteristics that make it unsuitable and/or more difficult to properly bond with the material of body 1200. For instance, the material of weight component 1120 can inherently comprise a weld-averse characteristic that can compromise the strength or durability of weld bonds between weight component 1120 and other materials such as the material of body 1200. As an example, if the material of weight component 1120 comprises tungsten, while the material of body 1200 comprises steel, then weight component 1120 could comprise a melting temperature of approximately 6150 degrees Fahrenheit, while body 1200 could comprise a melting temperature of approximately 2750 degrees Fahrenheit. Such large differences in melting temperatures and/or other physical characteristics may lead to undue deformation or liquefying of the material of body 1200 around a weld between body 1200 and weight component 1120, to such an extent that the original shape or contour of perimeter 1111 may not be maintained. In such examples, the weld-averse characteristic of the material of weight component 1120 relative to the material of body 1200 can comprise a propensity for deformation, brittleness, and/or cracking during or after weld-bonding.

As seen in FIG. 2, receptacle 2210 at body surface 1220 comprises receptacle base 2222 circumscribed by receptacle wall 2211. Receptacle wall 2211 also circumscribes a cavity over receptacle base 2222, where the cavity of receptacle 2210 is configured to at least partially accommodate weight 1100, and where receptacle wall 2211 is configured to secure perimeter 1111 of multi-density weight 1100.

In the present example, weight component 1110 comprises base 2114 and wall 2115 circumscribing inner portion 2113 over base 2114. As seen in FIGS. 2 and 4, wall 2115 can comprise an inner wall of periphery 1112 of weight component 1110. In addition, an outermost perimeter of periphery 1112 of weight component 1110 can comprise perimeter 1111 of multi-density weight 1100. Furthermore, in the present example, bottom 4117 (FIG. 4) of multi-density weight 1100 comprises a bottom of weight component 1110, and is abutted against receptacle base 2222 when multi-density weight 1100 couples to receptacle 2210.

The embodiment of FIGS. 1-4 also shows that perimeter 1121 of weight component 1120 can be secured at least partially along inner portion 2113 and/or periphery 1112 of weight component 1110. In the present example, bottom 4127 of weight component 1120 can also be abutted against base 2114 of weight component 1110 when weight component 1120 is secured at the inner portion of weight component 1110.

In the present and other examples, considering the weld-averse traits of weight component 1120, a bonding mechanism comprising at least one of a swedged bond, an epoxy bond, a sintered bond, and/or a shrink-fit bond can be used to secure perimeter 1121 and/or bottom 4127 of weight component 1120 to inner portion 2113, perimeter 1112, and/or base 2114 of weight component 1110. In the same or a different example, perimeter 1111 of multi-density weight 1100 can be secured along receptacle wall 2211 via at least one of a weld bond, a brazed bond, or a compression ring. In the latter case, the compression ring could be compressed between receptacle wall 2211 and perimeter 1111.

Figure 20:
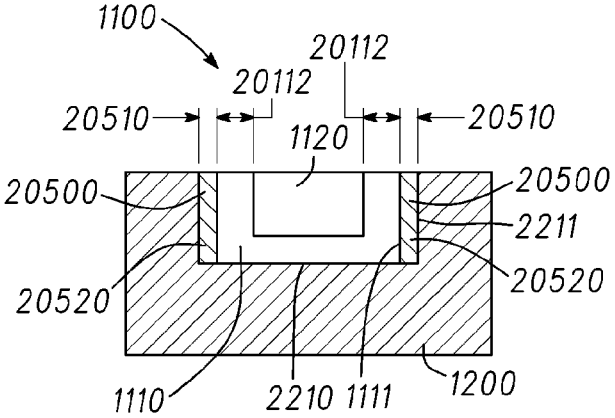
FIGS. 20 and 21 show different cross-sectional views of multi-density weights secured to receptacles in golf club bodies according to other embodiments.

In the case of a weld bond, there may be several approaches for weld bonding. Skipping ahead in the figures, FIG. 20 illustrates a cross-sectional close-up view of weight 1100 secured to receptacle 2210 of body 1200 via weld bond 20500. In the example of FIG. 20, weld gap 20510 can be allotted between receptacle wall 2211 and perimeter 1111, such as to permit insertion or seepage of welding material 20520 therebetween. Such weld gap 20510 may be as narrow as approximately 3 millimeters in some examples. Narrower weld gaps may be achieved, sometimes at a trade-off with final surface and/or cosmetic finish. In the same or other examples, wall thickness 20112 of weight component 1110, between perimeter 1111 and wall 2211, may be at least as thick as the weld gap to support heat dissipation and reduce permanent deformation during the welding process.

Figure 21:
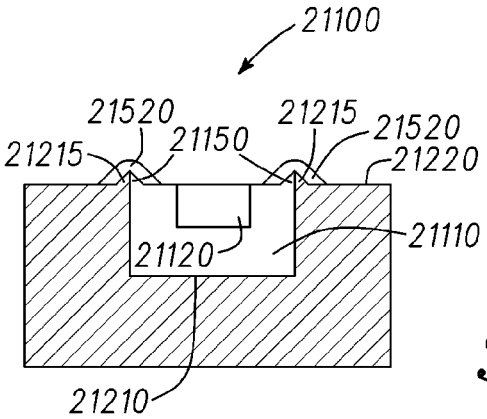

In other embodiments, a weld bond may be used without requiring a weld gap. FIG. 21 shows a cross-sectional view of weight 21100 secured to receptacle 21210 of club head body surface 21220 without the use of a weld gap. Weight 2100 can be a multi-density weight having weight components 21110 and 21120, which can be similar to weight components 1110 and 1120, respectively in FIGS. 1-4. The present example comprises ridge 21150 along a top perimeter of weight 21100, and ridge 21215 along a top perimeter of receptacle 21210. The embodiment of FIG. 21 can dispense with the need for a weld gap by relying instead on welding material 21520 forming weld bond 21500 at a junction between ridges 21150 and 21215. In the present example, ridge 21150 of weight 21100 is located along a top perimeter of weight 21100, while ridge 21215 is located along a top perimeter of receptacle 21210. There may be examples, however, where ridge 21150 is not continuous along the top perimeter of weight 2100, and/or where ridge 21215 is not continuous along the top perimeter of receptacle 21210. Other embodiments may dispense with one of ridges 21150 or 21215. As an example, ridge 21150 may be directly bonded to body surface 21220 with welding material 21520 if ridge 21215 were absent from the top perimeter of receptacle 21210. In another example, ridge 21215 may be directly bonded to weight 21100 with welding material 21520 if ridge 21150 were absent from the top perimeter of weight 21100. Although the application of welding material 21520 may leave a rough or protruded salient at the interface between weight 21100 and club head body surface 21220, such salient may be removed or otherwise blended in via a subsequent grinding, polishing, or other machining process if desired. There can be embodiments where one or more of ridges 21150 and/or 21215 may be referred to as a bead, and/or where the shape of thereof differs from that illustrated in FIG. 21. If desired, there can also be embodiments where a weld gap can be used in combination with ridges 21150 and/or 21215. There can also be examples where ridges can be used to secure other portions of weight 21100. For example, weight components 21120 and 21110 can be secured together using ridges similar to ridges 21215 and/or 21150 as described above with respect to weight 21100 and body surface 21220.

Figure 6:
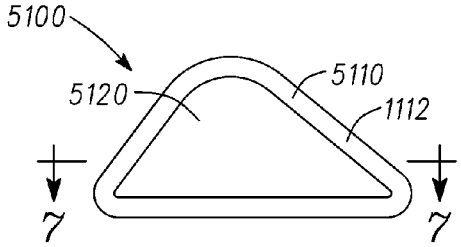
FIG. 6 presents a top view of the multi-density weight of the club of FIG. 5.
Figure 7:
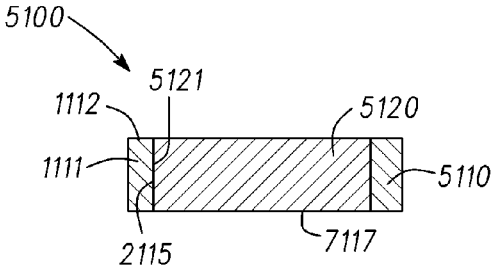
FIG. 7 shows a cross sectional view of the multi-density weight of FIG. 5, along a line 6-6 of FIG. 6.
Figure 5:
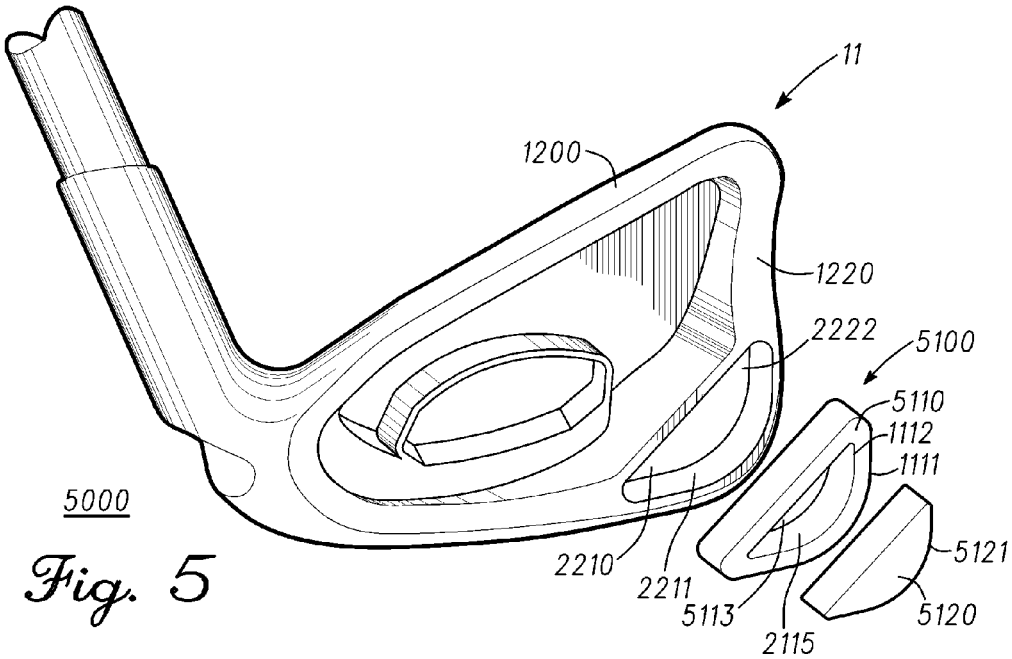
FIG. 5 illustrates a front perspective exploded view of another club having a body and a multi-density weight.

Backtracking through the figures, FIG. 5 illustrates a front perspective exploded view of club 50 having body 1200 and multi-density weight 5100. FIG. 6 presents a top view of multi-density weight 5100. FIG. 7 shows a cross sectional view of multi-density weight 1100 along a line 6-6 of FIG. 6. Club head 50 is similar to club head 10 (FIGS. 1-4), comprising multi-density weight 5100 similar to multi-density weight 1100 (FIGS. 1-4), but differing in that weight component 5110 of multi-density weight 5100 comprises no base similar to base 2114 of weight component 1110 (FIG. 2). Multi-density weight 5100 also comprises weight component 5120 and, because weight component 5110 comprises no base 2114 (FIG. 2), weight component 5120 can reach bottom 7117 of multi-density weight 5100 when secured at inner portion 5113 of weight component 5110. In the same or a different embodiment, the bottom of weight component 5120 can contact base 2114 of receptacle 2210 when multi-density weight 5100 is secured to body 1200. In the same or a different embodiment, because weight component 5110 comprises no base 2114 (FIG. 2), the bonding mechanism between weight components 5110 and 5120 is more focused on securing perimeter 5121 of weight component 5120 at least partially along wall 2115 of weight component 5121.

FIG. 8 presents a top view of multi-density weight 8100. FIG. 9 shows a cross sectional view of multi-density weight 8100 along a line 8-8 of FIG. 8 Multi-density weight 8100 is similar to multi-density weights 1100 (FIGS. 1-4) and 5100 (FIGS. 5-7), but comprises three weight components 8110, 8120, and 8130, rather than only two weight components. There can be other implementations where multi-density weight 8100 could comprise abutted bases and bottoms of weight components 8110, 8120, and/or 8130. For example, a bottom of weight component 8120 could be abutted against a base of weight component 8130. In the same or another example, a bottom of weight component 8130 can be abutted against a base of weight component 8110. In another example, the bottoms of both weight components 8120 and 8130 can be abutted against the base of weight component 8110. Other combinations and/or permutations are similarly possible.

In the present example, multi-density weight 8100 also comprises a shape different than the shape of multi-density weights 1100 or 5100. As a result, multi-density weight could be coupled at another receptacle different than receptacle 2210 (FIG. 2), such as at receptacle 1210 (FIG. 1), at another region of body 1200, or to another club different than club 1 (FIGS. 1-2).

Weight components 8110, 8120, and 8130 comprise materials different from each other, in the present embodiment, and could be arranged, for example, to gradually transition from least dense to most dense, or vice versa. In the same or a different example, weight component 8120 can comprise weld-averse traits similar to those of weight component 1120 (FIGS. 1-4), and could be secured using one of the bonding mechanisms described above with respect to for weight component 1120. Weight component 8110 can comprise a material that is suitable for welding in the present example, and could be secured using one of the mechanisms described above for weight component 1110 (FIGS. 1-4). In some examples, weight component 8130 could also comprise some of the weld-averse traits of weight component 8120.

Moving along, FIG. 10 illustrates a flowchart for a method 10000 of manufacturing a club in accordance with the present disclosure. In some embodiments, the club of method 10000 can be similar to club 1 (FIGS. 1-2), or to club 5 (FIG. 5).

Block 10100 of method 10000 comprises providing a body of a club head for the club of method 10000. In some embodiments, the body of the club head can be similar to body 1200 of club head 11 (FIG. 1, 2, 5). In other embodiments, the body of the club head of method 10000 can relate to other types of clubs different than those corresponding to FIGS. 1-9. The body of the club head can comprise a body material such as steel in some examples, and can comprise a recess similar to receptacle 2210 (FIG. 2, 5).

Block 10200 of method 10000 comprises providing a multi-density weight. The multi-density weight can be similar to one of multi-density weights 1100 (FIGS. 1-4), 5100 (FIGS. 5-7), and/or 8100 (FIGS. 8-9). Block 10200 can comprise several sub-blocks in some embodiments, as described below.

Sub-block 10210 of block 10200 comprises forming a first weight portion of the multi-density weight. In some embodiments, the first weight portion can be similar to weight components 1110 (FIGS. 1-4), 5110 (FIG. 5-7), or 8110 (FIGS. 8-9). In the same or a different embodiment, the first weight portion can comprise a first material different than a body material of the body of block 10100, where the first material has a first density. As an example, the first material can comprise a tungsten-nickel alloy material. The first material of the first weight portion of sub-block 10210 also exhibits a pro-bond characteristic relative to the body material of the body. In some embodiments, the pro-bond characteristic can enable proper welding of the first weight portion to the body of block 10100.

Sub-block 10220 of block 10200 comprises forming a second weight portion of the multi-density weight. In some embodiments, the second weight portion can be similar to weight components 1120 (FIGS. 1-4), 5120 (FIG. 5-7), or 8120 (FIGS. 8-9). In the same or a different embodiment, the second weight portion can comprise a second material different than the body material of the body or the first material of the first weight portion. The second material has a second density greater than the first density of the first weight portion in at least some embodiments. For example, the second material can comprise a tungsten material. The second material of the second weight portion of sub-block 10220 also exhibits an anti-bond characteristic relative to the body material of the body. In some embodiments, the anti-bond characteristic can be similar to the weld-averse trait described above with respect to weight component 1120.

In some embodiments, sub-block 10210 can comprise forming the first weight portion to comprise an inner space and a periphery conforming to a perimeter of the multi-density weight, while sub-block 10220 can comprise forming a perimeter of the second weight portion to nest in the inner space of the first weight portion. As an example, the periphery of the first weight portion can be similar to periphery 1112 as conformed to perimeter 1111 (FIGS. 1-7) for weights 1100 (FIGS. 1-4) and 5100 (FIGS. 5-7). As also seen in the example of FIGS. 1-4, the perimeter of the second weight portion can be similar to perimeter 1121 of weight component 1120, bounding weight component 1120 to nest in inner portion 2113 of weight component 1110. A similar analogy can be made with respect to perimeter 5121 bounding weight component 5120 to nest in inner portion 5113 of weight component 5110.

In examples similar to that of FIGS. 1-4, the inner space of the first weight portion can be bounded by a tub surface, and the second weight portion can conform to the tub surface of the first weight portion. In such examples, the inner space can be similar to inner portion 2113 (FIG. 2), as bounded by the tub surface formed by the combination of base 2114 and wall 2115, and the second weight portion conforms to the tub surface as shown for weight component 1120 coupled to inner portion 2113 (FIGS. 2, 4).

Sub-block 10230 of block 10200 comprises bounding the second weight portion of block 10220 with the first weight portion of block 10210 to form the multi-density weight. In some examples, the first weight portion can bound the second weight portion as illustrated in FIGS. 3-4 with respect to weight components 1110 and 1120. In other examples, the second first weight portion can bound the second weight portion as illustrated in FIGS. 6-7 with respect to weight components 5110 and 5120.

Sub-block 10230 can be performed in one of several different ways. In one example, the second weight portion can be bounded with the first weight portion by bonding the second weight portion to the inner space of the first weight portion with an epoxy material. In the example of FIGS. 1-4, the epoxy material can be located between base 2114 and a bottom of weight component 1120, and between wall 2115 of weight component 1110 and perimeter 1121 of weight component 1120.

Another way of performing sub-block 10230 can comprise swedging the second weight portion into the inner space of the first weight portion. In such embodiments, an inner wall defining the inner space of the first weight portion can comprise a perimeter or other dimensions configured to compress against the second weight portion. For instance, in the embodiment of FIG. 4, a perimeter of wall 2115 of weight portion 1110 can be substantially equal to, or slightly less than, perimeter 1121 of weight portion 1120. As a result, weight portion 1120 is held in place by compressive forces when force-pressed into the inner space within wall 2115 and thereby bounded by the weight portion 1110.

Figure 14:
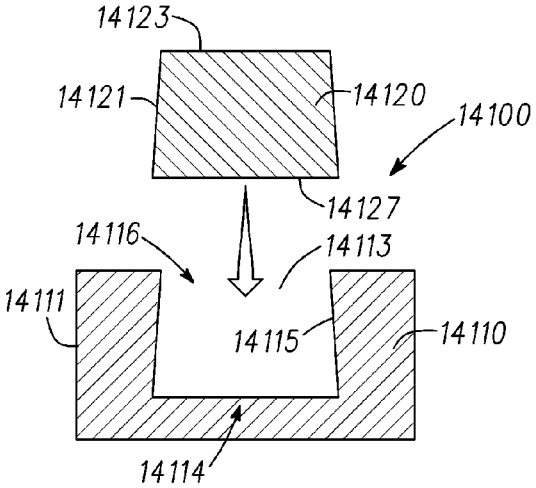
FIG. 14 illustrates an exploded cross sectional view of a multi-density weight similar to the multi-density weight of FIGS. 1-4.

In another example of swedging, such as shown in FIG. 14, multi-density weight 14100 can be similar to multi-density weight 1100 (FIGS. 1-4) and can comprise weight element 14110 to couple with weight element 14120. Weight elements 14110 and 14120 can be similar to weight elements 1110 and 1120, respectively, but bottom 14127 of weight element 14120 is slightly larger than opening 14116 of inner portion 14113 of weight element 14110. As a result, when weight element 14120 is swedged into inner portion 14113 of weight element 14110, at least one of bottom 14127 or wall 14115 may at least temporarily elastically deform to permit bottom 14127 to enter inner portion 14113 through opening 14116. Once swedged into inner portion 14113, wall 14115 may compress around perimeter 14121 of weight element 14120 to maintain weight element 14120 in place.

Figure 15:
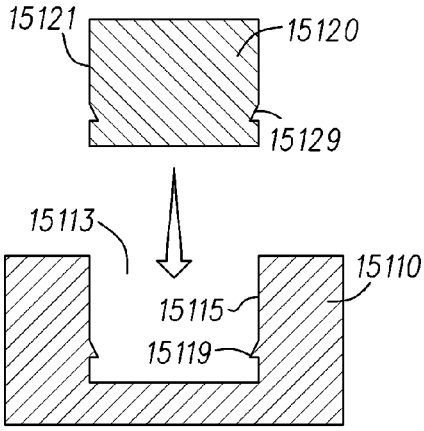
FIG. 15 illustrates an exploded cross sectional view of a multi-density weight similar to the multi-density weight of FIGS. 1-4 but comprising barbing elements.

FIG. 15 shows another example of swedging, similar to the example of FIGS. 4 and 14, but comprising weight elements 15110 and 15120. Weight elements 15110 and 15120 can be similar to weight elements 1110 and 1120, respectively, but each comprise respective barbing elements 15119 and 15129 configured to interlock with each other when weight element 15120 is swedged into inner portion 15113 of weight element 15110 to maintain weight element 15120 in place when wall 15115 of weight element 15110 compresses around perimeter 15121 of weight element 15120. In some examples, barbing elements 15119 and/or 15129 may interlock via compression or crushing when weight portion 15120 is force-pressed into inner space 15113 of weight portion 15110. Although in the present example barbing elements 15119 and 15129 are shown as respectively circumscribing perimeter 15121 and wall 15115, there can be other embodiments without full circumscription. There can also be embodiments comprising more than one set of barbing elements, and/or where the barbing elements are located elsewhere, such as near the top or bottom of perimeter 15121 and wall 15115.

Figure 11:
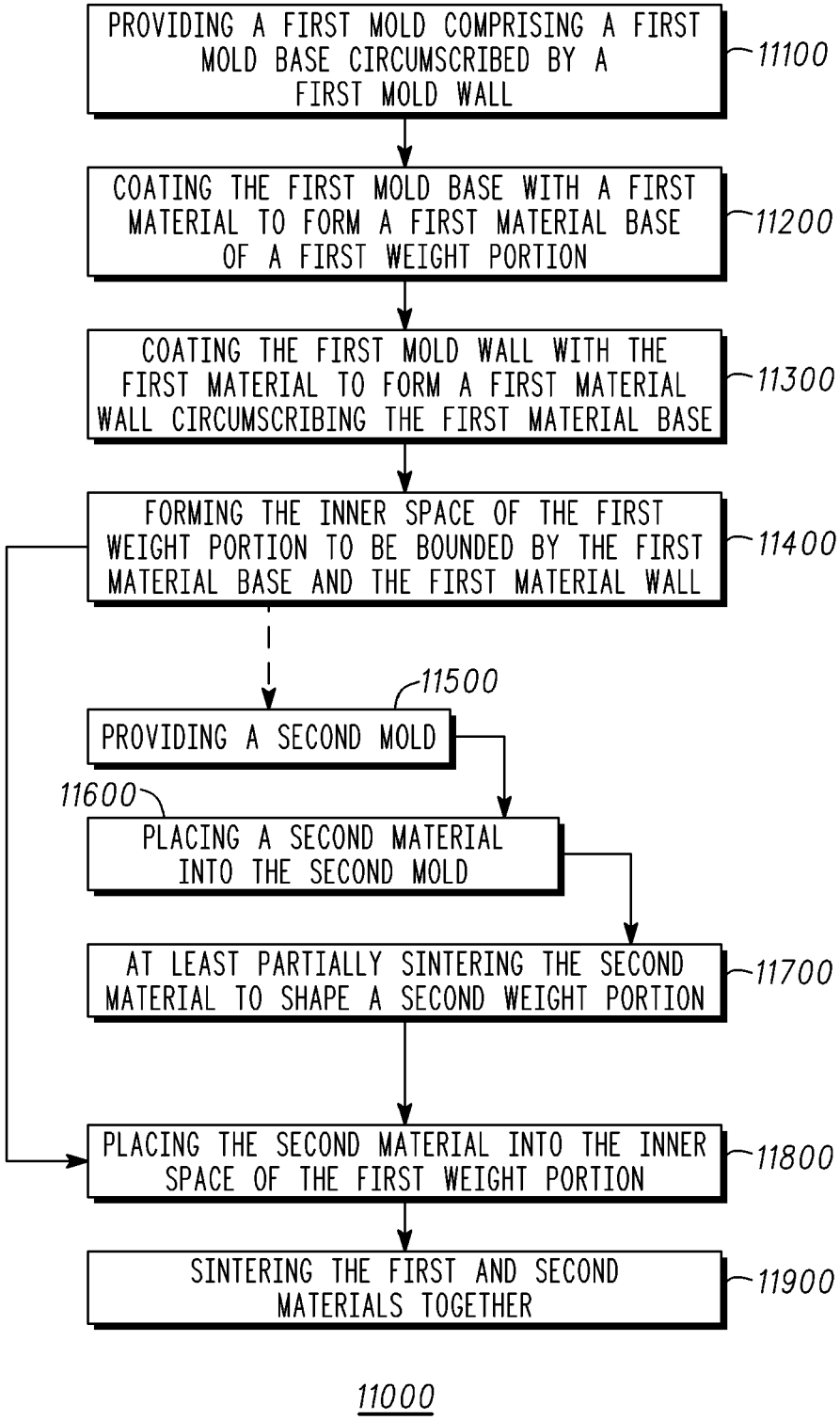
FIG. 11 illustrates a flowchart of a method for sintering in accordance with one example of the method of FIG. 10.
Figure 12:
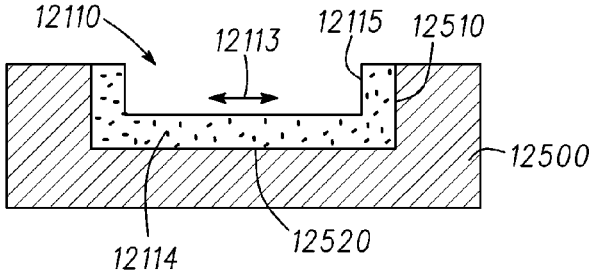
FIG. 12 illustrates a cross section of a mold used to form a weight portion of a multi-density weight.
Figure 13:
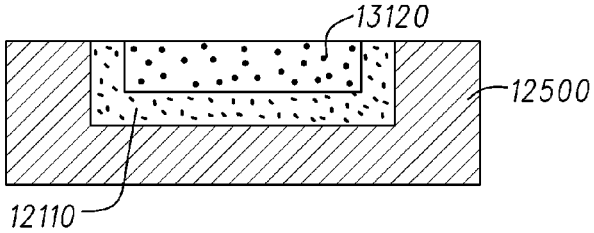
FIG. 13 illustrates a cross section of the mold of FIG. 12 used to form another weight portion of the multi-density weight of FIG. 12.

Continuing with other examples for sub-block 10230 in FIG. 10, another way of bounding the second weight portion with the first weight portion can comprise sintering, such as shown in FIGS. 11-12. FIG. 11 illustrates a flowchart of a method 11000 for sintering the second weight portion of block 10220 at the inner space of the first weight portion of block 10210. FIG. 12 illustrates a cross section of mold 12500 used to form weight portion 12110, where weight portion 12110 can correspond to the first weight portion of block 10210 (FIG. 10). FIG. 13 illustrates a cross section of mold 12500 used to form weight portion 13120, where weight portion 13120 can correspond to the second weight portion of block 10220.

Block 11100 of method 11000 comprises providing a first mold comprising a first mold base circumscribed by a first mold wall. In some examples, the mold can be similar to mold 12500 of FIGS. 12-13.

Block 11200 of method 11000 comprises coating the first mold base with the first material to form a first material base. In the example of FIG. 12, the first material can correspond to base 12114 over mold base 12520. In the same or a different example, the first material in block 11200 can be similar to a material of weight component 1110 as described above. In the same or a different embodiment, the first material can be in powdered form when first placed over the mold base.

Block 11300 of method 11000 comprises coating the first mold wall with the first material to form a first material wall circumscribing the first material base. In the example of FIG. 12, the first material wall can correspond to wall 12115 bounded by mold wall 12510 and circumscribing base 12114. In the same or a different embodiment, the first material can also be in powdered form when first placed within the bounds of mold wall 12510.

Block 11400 of method 11000 comprises forming the inner space of the first weight portion to be bounded by the first material base and the first material wall. In some examples, the inner space can correspond to inner space 12113, similar to inner portion 2113 of weight component 1110 (FIG. 1). In the same or different examples, the inner space can be formed by shaping the powdered form of the first material to the desired contour for the inner portion.

Method 11000 also comprises block 11800, comprising placing a second material of the second weight portion into the inner space of the first weight portion. In the example of FIG. 13, the second material can correspond to the material of weight portion 13120, which can be similar to weight component 1120 (FIGS. 1-4). In the same or a different embodiment, the second material can be in powdered form when first placed into the inner space of the first weight. In some examples, the first material of the first weight portion can be at least partially sintered before block 11800 is carried out.

Block 11900 of method 11000 comprises sintering the first and second materials of the first and second weight portions together. Such sintering can be performed at a suitable temperature and/or pressure to effectively bond the first and second materials together.

In some examples, method 11000 can comprise blocks 11500-11700 between blocks 11400 and 11800. In such examples, block 11500 can comprise providing a second mold, while block 11600 can comprise placing the second material of the second weight portion into the second mold. The second material can be in powdered form when placed into the second mold in some examples. Block 11700 then comprises at least partially sintering the second material in the second mold to shape the second weight portion to correspond to the contour of the inner space of the first weight portion as formed in block 11400. Method 11000 can then continue in block 11800 as described above when the second weight portion is removed from the second mold and placed into the inner space of the first weight portion.

Returning to FIG. 10, block 10300 of method 10000 comprises coupling the multi-density weight of block 10200 to a region of the body of block 10100. In at least some embodiments, a perimeter of the multi-density weight can be secured to a wall of the recess of the body described in block 10100, where the wall can be similar to wall 2211 of receptacle 2210 (FIGS. 2, 5).

The multi-density weight can be coupled at one of several regions of the body depending on the type of club head involved and the desired effect upon the center of gravity, mass distribution, launch angle, hook/slide tendencies, and/or other characteristics of the club head. As seen in FIGS. 2, and 5, with respect to the shape of receptacle 2210 and the corresponding shape of multi-density weight 1100, the region of the body can comprise a lower toe-shaped region of the club head. In other embodiments, the region of the body to which the multi-density weight couples can comprise an upper toe-shaped region, a hosel-shaped region, a heel-shaped region a backside-shaped region, an upper-half shaped region, and/or a lower-half shaped region of the body. In embodiments where the region of the body is not circular, such as seen in FIGS. 2 and 5 with respect to the toe region of body 1200, the multi-density weight is also accordingly not circular to conform to the contour of the region of the club head.

In some examples, block 10300 can be carried out by welding the multi-density weight to the region of the body. For example, in the embodiment of FIGS. 1-4, a weld may be formed to join weight component 1110 to at least receptacle wall 2211 of body 2211. Block 10300 can also be carried out in some embodiments by brazing the multi-density weight to the region of the body. For example, in the embodiment of FIGS. 1-4, a brazed joint can be produced when capillary action between receptacle wall 2211 of body 1200 and perimeter 1111 of weight component 1110 absorbs melted brazing material to secure multi-density weight 1100 to receptacle 2211 of body 1200.

Figure 16:
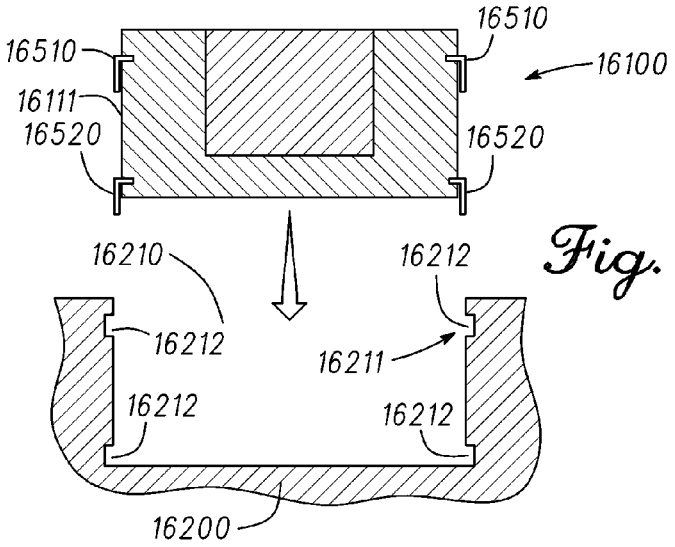
FIG. 16 illustrates an exploded cross sectional view of a multi-density weight being coupled with a recess of a body of a club head via compression elements.
Figure 17:
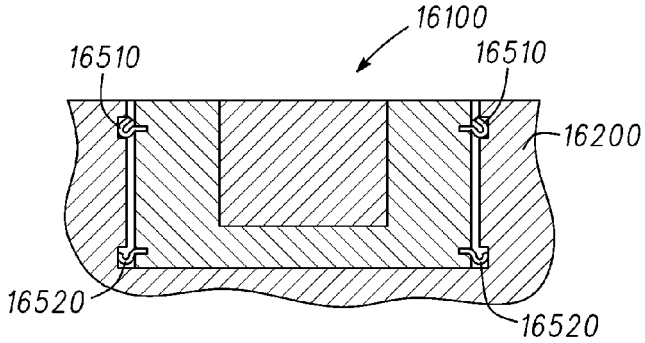
FIG. 17 illustrates a cross sectional view of the multi-density weight and recess of FIG. 16 coupled together.

There can be examples where block 10300 of method 10000 is carried out by compressing a compression element between the multi-density weight and the region of the body. In such examples, block 10200 can further comprise providing the compression element coupled at least partially around the perimeter of the multi-density weight, while block 10300 can comprise expansively deforming the compression element between the multi-density weight and a wall of a recess at the region of the body. In the same or other examples, the compression element can comprise a compression ring. For instance, FIG. 16 shows an embodiment of multi-density weight 16100 being coupled with recess 16210 of body 16200 of a club head, where multi-density weight 16100 is similar to multi-density weight 1100 (FIGS. 1-4), but comprises compression elements 16510 and 16520. FIG. 17 shows multi-density weight 16100 as coupled with recess 16210 (FIG. 16). In the example of FIGS. 16-17, compression elements 16510 and 16520 comprise compression rings that at least partially circumscribe perimeter 16111 of multi-density weight 1600. When pressed into recess 16210, as shown in FIG. 17, compression elements 16510 deform or bulge against wall 16211 and thereby secure multi-density weight 16100 at recess 16210. FIGS. 16-17 show compression elements 16510 and 16520 coupling with respective grooves 16212 of wall 16211, but there can be other embodiments where one or more compression elements 16510 and/or 16520 compress against a wall similar to wall 16211 but comprising no grooves. There can be embodiments with only one compression element, rather than the two compression rings 16510 and 16520 of multi-density weight 1600. As an example, some embodiments may use only compression ring 16520.

In other embodiments, the compression element can comprise one or more protrusions instead of a compression ring, where the one or more protrusions can be configured to buckle against the wall of the recess when the multi-density weight is pressed against the recess. For example, in some embodiments, the protrusion could protrude past a top surface of the multi-density weight, and would bulge against the top rim of the recess when buckled. In another embodiment, the protrusion could protrude past a bottom surface of the multi-density weight, and would bulge against the bottom of the wall of the recess when buckled.

Figure 18:
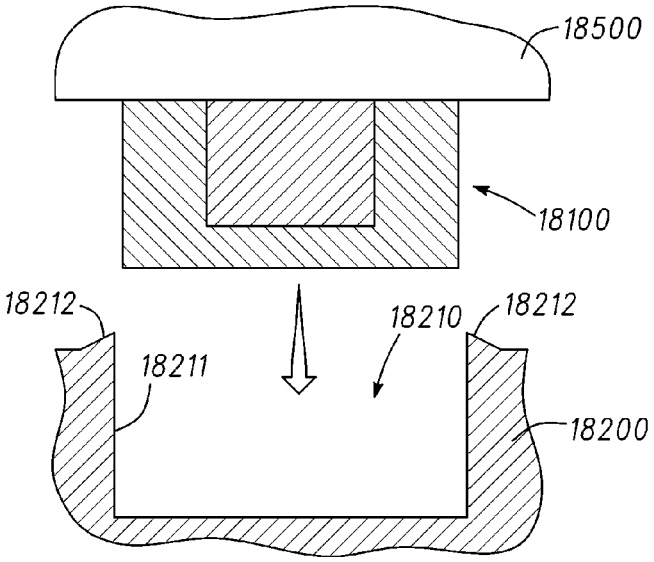
FIG. 18 shows a multi-density weight being pressed by a press into a recess a body of a club head comprising a deformable lip.
Figure 19:
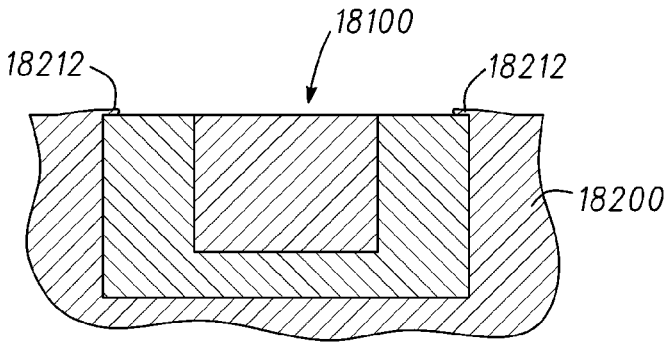
FIG. 19 shows the multi-density weight and recess of FIG. 18 coupled together.

Block 10300 also can be carried out in accordance with FIGS. 18-19 in some embodiments. FIG. 18 shows multi-density weight 18100 being pressed by press 18500 into recess 18210 of body 18200 of a club head, while FIG. 19 shows multi-density weight 18100 as coupled with recess 18210. Multi-density weight 18100 is similar to multi-density weight 1100 (FIGS. 1-4), and recess 18210 is similar to recess 2210 (FIG. 2), but recess 18210 differs by comprising lip 18212 at a rim of wall 18211 of recess 18210. As seen in FIGS. 18-19, as press 18500 presses multi-density weight 18100 into recess 18210, press 18500 folds, bends, or otherwise deforms lip 18212 over at least a portion of a top of multi-density weight 18100, thereby securing multi-density weight 18100 within recess 18210. Although in the present example, the rim of wall 18211 is completely circumscribed by lip 18212, there can be other examples where lip 18212 may circumscribe only a portion the rim of wall 18211, and/or there may be other lips similar to lip 18212 at other portions of the rim of wall 18211. In some examples, a 60-120 ton press may be used to press multi-density weight 18100 into recess 18210.

There can also be examples where one or more of blocks 10300 and/or 10230 of method 10000 can be carried out by plating a portion of at least one of the first or second weight portions. Some embodiments may comprise plating at least part of an exterior of the second weight component of block 10220, such that the plating material will be located between the second weight component and the first weight component when block 10230 is carried out to bound the second weight portion with the first weight portion. In the same or a different embodiment, at least part of an exterior of the first weight component of block 10210 can be plated such that the plating material will be located between the second weight component and the first weight component when block 10230 is carried out, and/or such that the plating material will be located between the multi-density weight and the region of the body when block 10300 is carried out. In the same or different embodiments, the plating material can deform when blocks 10230 and/or 10300 of method 10000 are carried out, including situations where at least part of the multi-density weight is swedged.

In some examples, one or more of the different blocks of method 10000 and/or 11000 can be combined into a single block or performed simultaneously, and/or the sequence of such blocks can be changed. For example, blocks 10220 and 10230 can be combined into a single block in some embodiments, such as when blocks 11800-11900 of method 11000 are carried out. In the same or other examples, some of the blocks of method 10000 and/or method 11000 can be subdivided into several sub-blocks. For example, providing the body of the club head in block 10100 may comprise further sub-blocks such as forming a strike face of the golf club head. There can also be examples where method 10000 and/or 11000 can comprise further or different blocks. As an example, method 10000 can also comprise providing a golf club shaft to attach to the club head of block 10100. Method 10000 and/or 11000 can also comprise optional blocks in some implementations. For example, blocks 11500, 11600, and 11700 can be optional in some examples. Other variations can be implemented for method 10000 and/or method 11000 without departing from the scope of the present disclosure.

Although the club heads with multiple density weighting and methods of manufacturing the same have been described herein with reference to specific embodiments, various changes may be made without departing from the spirit or scope of the golf club attachment mechanism and related methods. Various examples of such changes have been given in the foregoing description. For instance, although FIGS. 1-2 show multi-density weight 1100 inserted such that the top surfaces of weight portions 1110 and 1120 face towards the exterior of golf club head 11, there can also be embodiments as previously described where the top surface of weight portions 1110 and 1120 can face towards an interior of golf club head 11 when multi-density height 1100 couples to receptacle 2210 of body 1200. Accordingly, in such examples, where bottom end 4127 of weight component 1110 faces the exterior of golf club head 11, bottom 4127 of weight component 1120 is covered by base 2114 of weight component 1110 and is thus not externally visible.

The disclosure of embodiments of the club heads with multiple density weighting and methods of manufacturing the same is intended to be illustrative of the scope of the application and is not intended to be limiting. It is intended that the scope of this application shall be limited only to the extent required by the appended claims. For example, it will be readily apparent that the club heads with multiple density weighting and methods of manufacturing the same discussed herein may be implemented in a variety of embodiments, and that the foregoing discussion of certain of these embodiments does not necessarily represent a complete description of all possible embodiments. Therefore, the detailed description of the drawings, and the drawings themselves, disclose at least one preferred embodiment of the golf club attachment mechanism and related methods, and may disclose alternative embodiments of the club heads with multiple density weighting and methods of manufacturing the same.

All elements claimed in any particular claim are essential to the club heads with multiple density weighting and/or methods of manufacturing the same claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a body comprising a receptacle at a surface of the body;

a multi-density weight comprising:

a first weight component comprising a first density, an inner portion and a periphery around the inner portion; and a second weight component comprising a second density different from the first density and secured to the inner portion of the first weight component;

and a density relationship comprising at least one of:

the second density being greater than the first density; or the first density and second density being greater than a density of the body;

wherein:

the body, the first weight component, and the second weight component comprise materials different from each other;

the receptacle comprises a receptacle base and a receptacle wall at least partially circumscribing the receptacle base;

the multi-density weight comprises a perimeter secured to the receptacle wall; and the second weight component comprises a weld-averse trait with respect to the body.

2. The golf club head of claim 1, wherein:

the second weight component comprises a metallic material; and the weld-averse trait comprises at least one of:

a propensity for brittleness, cracking, or non-elastic deformation after welding.

3. The golf club head of claim 1, wherein:

the multi-density weight comprises a swedged bond to secure the second weight component along the inner portion of the first weight component; and the swedged bond comprises a perimeter of the second weight component compressed against the inner portion of the first weight component.

4. The golf club head of claim 3, wherein:

the swedged bond further comprises at least one of:

a barbing element between the perimeter of the second weight component and the inner portion of the first weight component; or a bottom of the second weight component larger than an opening of the inner portion before being located within the inner portion.

5. The golf club head of claim 1, wherein:

the perimeter of the multi-density weight is non-circular to conform to a shape of the surface of the body.

6. The golf club head of claim 1, wherein:

a surface of the first weight component faces an exterior of the golf club head; and a surface of the second weight component faces the exterior of the golf club head.

7. The golf club head of claim 1, wherein:

the multi-density weight further comprises:

a third weight component coupled between the first and second weight components and comprising a third density different from the first density and second density.

8. The golf club head of claim 1, wherein:

when the second density is greater than the first density;

the body comprises at least one of:

a steel material or a titanium material;

a material of the first weight component comprises at least one of:

a first tungsten material or a copper material;

the material of the second weight component comprises at least one of:

a second tungsten material, a brass material, a gold material, or a lead material.

9. The golf club head of claim 1, wherein:

the first weight component comprises:

a first top surface;

a first bottom surface; and a first base between the top and bottom surfaces and opposite the bottom surface; the second weight component comprises:

a second top surface; and a second bottom surface opposite the second top surface;

the first top surface of the first weight component faces an interior of the golf club head;

the second top surface of the second weight component faces the interior of the golf club head;

a second bottom surface of the second weight component is covered by the first base of the first weight component; and a first bottom surface of the first weight component faces an exterior of the golf club head.

10. The golf club head of claim 1, further comprising:

a compression element at least partially around the perimeter of the multi-density weight;

wherein:

the compression element is compressed and expansively deformed between the multi-density weight and a recess at the receptacle wall.

11. The golf club head of claim 1, further comprising:

a plating layer plating a portion of at least one of the first or second weight components;

wherein:

the plating layer is deformed between swedged portions of the first and second weight components.

12. The golf club head of claim 1, further comprising:

the second weight component comprises a sintered bond with the inner portion of the first weight component.

13. A method comprising:

providing a body of a club head;

providing a multi-density weight; and coupling the multi-density weight to a region of the body;

wherein:

providing the multi-density weight comprises:

forming a first weight portion out of a first material different than a body material of the body and having a first density, the first weight portion comprising an inner space and a pro-bond characteristic;

forming the first weight portion out of the first material comprises:

providing a first mold comprising a first mold base circumscribed by a first mold wall;

coating the first mold base with the first material to form a first material base;

coating the first mold wall with the first material to form a first material wall circumscribing the first material base; and forming the inner space of the first weight portion to be bounded by the first material base and the first material wall;

forming a second weight portion out of a second material different than the body material and the first material and having a second density, the second weight portion comprising an anti-bond characteristic; and bounding the second weight portion at least partially within the inner space of the first weight portion to form the multi-density weight.

14. The method of claim 13, wherein:

forming the first weight portion out of the first material comprises:

forming the first weight portion to comprise an inner wall bounding at least a portion of the inner space;

and forming the second weight portion out of the second material comprises:

forming a perimeter of the second weight portion to fit in the inner space bounded by the inner wall of the first weight portion.

15. The method of claim 14, wherein:

providing the multi-density weight further comprises:

forming a perimeter of the multi-density weight as non-circular to conform to a non-circular contour of the region of the body.

16. The method of claim 14, wherein:

forming the first weight portion further comprises:

forming the first weight portion to comprise a tub surface bounding the inner space of the first weight portion, the tub surface comprising the inner wall;

and forming the perimeter of the second weight portion further comprises:

forming the second weight portion to conform to the tub surface of the first weight portion.

17. The method of claim 13, wherein:

bounding the second weight portion comprises:

placing the second material into the inner space of the first weight portion; and forming the second weight portion comprises:

sintering the first and second materials together.

18. The method of claim 17, wherein:

forming the first weight portion out of the first material further comprises:

at least partially sintering the first material base and the first material wall before placing the second material into the inner space of the first weight portion.

19. The method of claim 13, wherein:

forming the second weight portion out of the second material comprises:

providing a second mold;

placing the second material into the second mold; and at least partially sintering the second material to shape the second weight portion;

and bounding the second weight portion comprises:

placing the second weight portion into the inner space of the first weight portion; and sintering the first and second weight portions together.

20. The method of claim 13, wherein:

forming the second weight portion out of the second material occurs simultaneously with bounding the second weight portion at least partially within the inner space of the first weight portion.

21. A golf club head comprising:

a body comprising a body material and a receptacle at a surface of the body;

a multi-density weight comprising:

a first weight component comprising a first density, an inner portion and a periphery around the inner portion; and a second weight component comprising a second density different from the first density and secured to the inner portion of the first weight component;

wherein:

the first weight component and the second weight component comprise materials different from each other;

the receptacle comprises a receptacle base and a receptacle wall at least partially circumscribing the receptacle base;

the multi-density weight comprises a perimeter secured to the receptacle wall;

the body material comprises a specific gravity of approximately 4 to approximately 8.5;

the first density comprises a specific gravity of approximately 8 to approximately 11; and the second density comprises a specific gravity of approximately 14 to approximately 20.

22. The golf club head of claim 21, wherein:

the specific gravity of the body material is approximately 4 to approximately 4.8; and the second weight component comprises a material having a weld-averse trait with respect to the body.

23. The golf club head of claim 21, further comprising:

a density relationship comprising at least one of:

the second density being greater than the first density; or the first density and second density being greater than a density of the body.

24. The golf club head of claim 21, wherein:

the multi-density weight further comprises:

a third weight component coupled between the first and second weight components and comprising a third density different from the first density and second density.

* * * * *